US009004218B2

(12) United States Patent
Gulati et al.

(10) Patent No.: US 9,004,218 B2
(45) Date of Patent: Apr. 14, 2015

(54) JOYSTICK WITH IMPROVED CONTROL FOR WORK VEHICLES

(71) Applicant: CNH Industrial America, LLC, New Holland, PA (US)

(72) Inventors: Navneet Gulati, Naperville, IL (US); Duqiang Wu, Bolingbrook, IL (US); Aditya Singh, Westmont, IL (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 14/265,417

(22) Filed: Apr. 30, 2014

(65) Prior Publication Data

US 2014/0373666 A1 Dec. 25, 2014

Related U.S. Application Data

(60) Provisional application No. 61/838,298, filed on Jun. 23, 2013.

(51) Int. Cl.
*G05G 9/047* (2006.01)
*G05G 5/03* (2008.04)

(52) U.S. Cl.
CPC ..... *G05G 9/047* (2013.01); *G05G 2009/0474* (2013.01); *Y10T 74/20474* (2013.01); *G05G 5/03* (2013.01); *G05G 2009/04766* (2013.01)

(58) Field of Classification Search
CPC ..... E02F 9/2004
USPC ..... 180/315, 333, 335, 336; 74/473.3, 74/473.33, 473.12, 543; 200/339, 556
See application file for complete search history.

(56) References Cited

U.S. PATENT DOCUMENTS

| | | | | | |
|---|---|---|---|---|---|
| 3,625,302 | A * | 12/1971 | Lauck | 180/6.48 |
| 5,347,204 | A * | 9/1994 | Gregory et al. | 318/632 |
| 5,412,299 | A * | 5/1995 | Gregory et al. | 318/628 |
| 5,414,620 | A * | 5/1995 | Kauffman | 700/56 |
| 5,537,818 | A * | 7/1996 | Hosseini et al. | 60/327 |
| 5,860,231 | A * | 1/1999 | Lee et al. | 37/348 |
| 5,946,832 | A * | 9/1999 | Koivuranta et al. | 37/444 |
| 6,459,228 | B1 * | 10/2002 | Szulyk et al. | 318/632 |
| 6,550,562 | B2 | 4/2003 | Brandt et al. | |
| 6,854,554 | B2 | 2/2005 | Brandt et al. | |
| 6,923,084 | B2 * | 8/2005 | Kramer et al. | 74/473.33 |
| 7,117,760 | B2 * | 10/2006 | Kramer et al. | 74/473.33 |
| 8,050,780 | B2 * | 11/2011 | Tessier et al. | 700/63 |
| 8,272,468 | B2 * | 9/2012 | Iida | 180/333 |
| 2005/0211449 | A1 * | 9/2005 | Bares et al. | 172/2 |

(Continued)

FOREIGN PATENT DOCUMENTS

EP 0361666 4/1990

*Primary Examiner* — Paul N Dickson
*Assistant Examiner* — Darlene P Condra
(74) *Attorney, Agent, or Firm* — Sue C. Watson

(57) ABSTRACT

A system for controlling a work vehicle is disclosed. The system may include a controller configured to control motion of the work vehicle and an electronic joystick communicatively coupled to the controller. The electronic joystick may be configured to transmit signals to the controller as it is moved between a neutral position and a full stroke position. The joystick may also be configured such that a varying joystick force is required to move the joystick between the neutral and full stroke positions. In addition, a rate of change of the joystick force may be varied as the electronic joystick is moved across a start/stop position defined between the neutral and full stroke positions.

20 Claims, 10 Drawing Sheets

(56) References Cited

U.S. PATENT DOCUMENTS

2006/0150767 A1* 7/2006 Shah ..... 74/730.1
2006/0209024 A1* 9/2006 Gharsalli ..... 345/161
2006/0248885 A1* 11/2006 Buckmier et al. ..... 60/484
2010/0287921 A1* 11/2010 Trifunovic ..... 60/327
2011/0088961 A1* 4/2011 Case et al. ..... 180/333
2013/0261902 A1* 10/2013 Zhdanov et al. ..... 701/50
2013/0302089 A1* 11/2013 Sina ..... 404/84.1

* cited by examiner

JOYSTICK WITH IMPROVED CONTROL FOR WORK VEHICLES

FIELD OF THE INVENTION

The present subject matter relates generally to work vehicles and, more particularly, to an electronic joystick configuration that provides enhanced feedback for improved control of a work vehicle.

BACKGROUND OF THE INVENTION

For many work vehicles, such as skid steer loaders, it is important to provide operators some type of feedback to maximize productivity and to allow for effective control of the vehicle. Typically, the feedback is associated with the operating state of the vehicle and/or the operating/environmental conditions within which the vehicle is being operated. This feedback may be in the form of engine sounds, hydraulic sounds and/or various other forms. For example, one type of feedback that has typically been provided to operators derives from the change in force required to move pilot joysticks (referred to herein as hydraulically-linked joysticks) across the joystick position at which the vehicle begins to start/stop motion. By providing an indication of the initiation or termination of vehicle movement, such feedback allows an operator to precisely control the operation of the work vehicle.

For a conventional hydraulically-linked joystick, the force required to move the joystick generally corresponds to the sum of two different forces. The first force derives from the spring coupled to the joystick and is directly proportional to the magnitude of the movement of the joystick. Specifically, a single spring is typically coupled to the joystick that is configured to apply a linearly increasing spring force as the joystick is moved from its neutral position towards its full stroke position. The second force acting on the joystick is related to the hydraulic pressure within the system, namely the pilot pressure for the joystick and the downstream pressure controlled by the joystick. Since the hydraulic pressure within the system increases/decreases significantly at the point at which the vehicle starts/stops motion, this second force forms the basis for providing the desired operator feedback.

For example, FIG. 1 illustrates a graph charting joystick force or torque (y-axis) versus joystick angular position (x-axis) for a conventional hydraulically-linked joystick. Curve 600 charts the joystick torque deriving from the hydraulic pressure within the system and curve 602 charts the sum of the joystick torques (i.e., the sum of the torques deriving from the spring and pressure forces). As shown, an initial region 604 exists at which the torque changes as the spring is engaged/disengaged and the hydraulic pressure varies. Beyond this initial region 604, the joystick torque increases linearly as the joystick is moved towards the joystick position at which vehicle motion starts/stops (indicated by line 200). As shown in FIG. 1, at the start/stop position 200, the joystick torque deriving from the hydraulic pressure changes significantly (indicated by bracket 606), thereby providing for a substantial increase/decrease in the overall torque required to move the joystick across the start/stop position 200. This change in torque allows for the operator to easily identify the start/stop position 200 when operating the work vehicle.

With modern electro-hydraulic (EH) control systems, conventional hydraulically-linked joysticks have been replaced by electronic joysticks that substitute electrical connections for the hydraulic connections. Accordingly, due to the decoupling of the hydraulic pressure, current electronic joysticks lack the force-related feedback provided by conventional hydraulically-linked joysticks. For example, FIG. 2 illustrates a graph charting joystick torque (y-axis) versus joystick angular position (x-axis) for a typical electronic joystick. As shown, curve 608 includes a very short, initial region 610 at which the force initially increases/decreases. Thereafter, the joystick force increases/decreases linearly with movement of the joystick. Thus, the operator is not provided any feedback as to when the joystick is about to be moved across the start/stop position 200. As a result, with electronic joysticks, operators have lost the ability to "feel" the start/stop point 200 of a work vehicle's motion, which significantly inhibits the controllability of the vehicle (particularly with respect to performing tasks that require precise vehicle control, such as maneuvering through tight spaces).

Accordingly, a joystick configuration that provides for enhanced operator feedback when using an electronic joystick would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a system for controlling a work vehicle. The system may include a controller configured to control motion of the work vehicle and an electronic joystick communicatively coupled to the controller. The electronic joystick may be configured to transmit signals to the controller as it is moved between a neutral position and a full stroke position. The joystick may also be configured such that a varying joystick force is required to move the joystick between the neutral and full stroke positions. In addition, a rate of change of the joystick force may be varied as the electronic joystick is moved across a start/stop position defined between the neutral and full stroke positions.

In another aspect, the present subject matter is directed to a system for controlling a work vehicle. The system may include a controller configured to control motion of the work vehicle and an electronic joystick communicatively coupled to the controller. The electronic joystick may be configured to transmit signals to the controller as it is moved between a neutral position and a full stroke position. In addition, the system may include a vibration source associated with the electronic joystick. The vibration source may be configured to generate a vibratory response when the electronic joystick is moved across a start/stop position defined between the neutral and full stroke positions.

In a further aspect, the present subject matter is directed to a work vehicle including an engine and a hydrostatic drive unit coupled to the engine. The hydrostatic drive unit may be configured to adjust a travel speed of the work vehicle. The work vehicle may also include a controller communicatively coupled to the hydrostatic drive unit an electronic joystick communicatively coupled to the controller. The electronic joystick may be configured to transmit signals to the controller for controlling the hydrostatic drive unit as the electronic joystick is moved between a neutral position and a full stroke position. The electronic joystick may also be configured such that a varying joystick force is required to move the electronic joystick between the neutral and full stroke positions. In addition, a rate of change of the joystick force may be varied as the electronic joystick is moved across a start/stop position defined between the neutral and full stroke positions.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
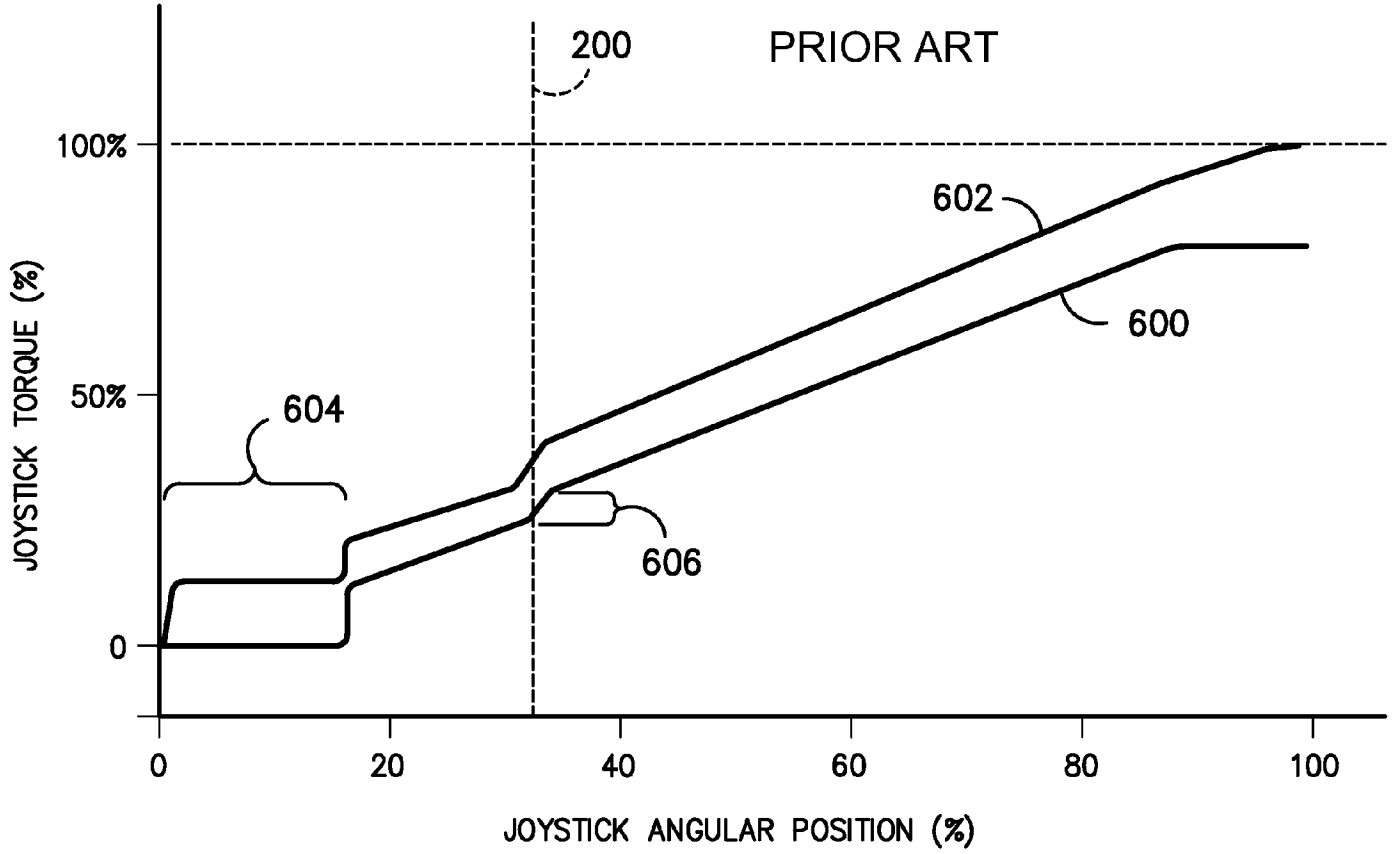
FIG. 1 illustrates a graph charting joystick torque (y-axis) versus joystick angular position (x-axis) for a conventional hydraulically-linked joystick.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to an electronic joystick that provides enhanced feedback to the operator. Specifically, in several embodiments, the joystick may be configured such that a significant change in joystick force occurs when the joystick is moved across the joystick position at which the work vehicle starts and stops motion. As a result, the electronic joystick may be configured to provide comparable feedback to that of conventional hydraulically-linked joysticks. Additionally, in alternative embodiments, the electronic joystick may be configured to provide any other type of feedback to the operator, such as by providing a vibratory response when the joystick is moved across the start/stop joystick position.

It should be appreciated that, as used herein, the term "electronic joystick" is used to refer to a joystick that is not directly hydraulically coupled to the hydraulic system of a work vehicle (i.e., as opposed to hydraulically-linked joysticks). For instance, an electronic joystick may correspond to a joystick that is electrically coupled or otherwise communicatively coupled to a controller of the work vehicle. In such an embodiment, the signals transmitted from the joystick to the controller may then be used by the controller as the basis for adjusting the pressure within the hydraulic system.

It should also be appreciated that, although the disclosed operator feedback is described herein as providing an indication of the start/stop joystick position for vehicle movement, the feedback may be associated with any other suitable operating states, conditions and/or parameters. For instance, in one embodiment, the force-related feedback provided by the joystick may be associated with implement control, such as by providing an indication of the start/stop joystick position for movement of an implement, such as a bucket or a boom.

Figure 3:
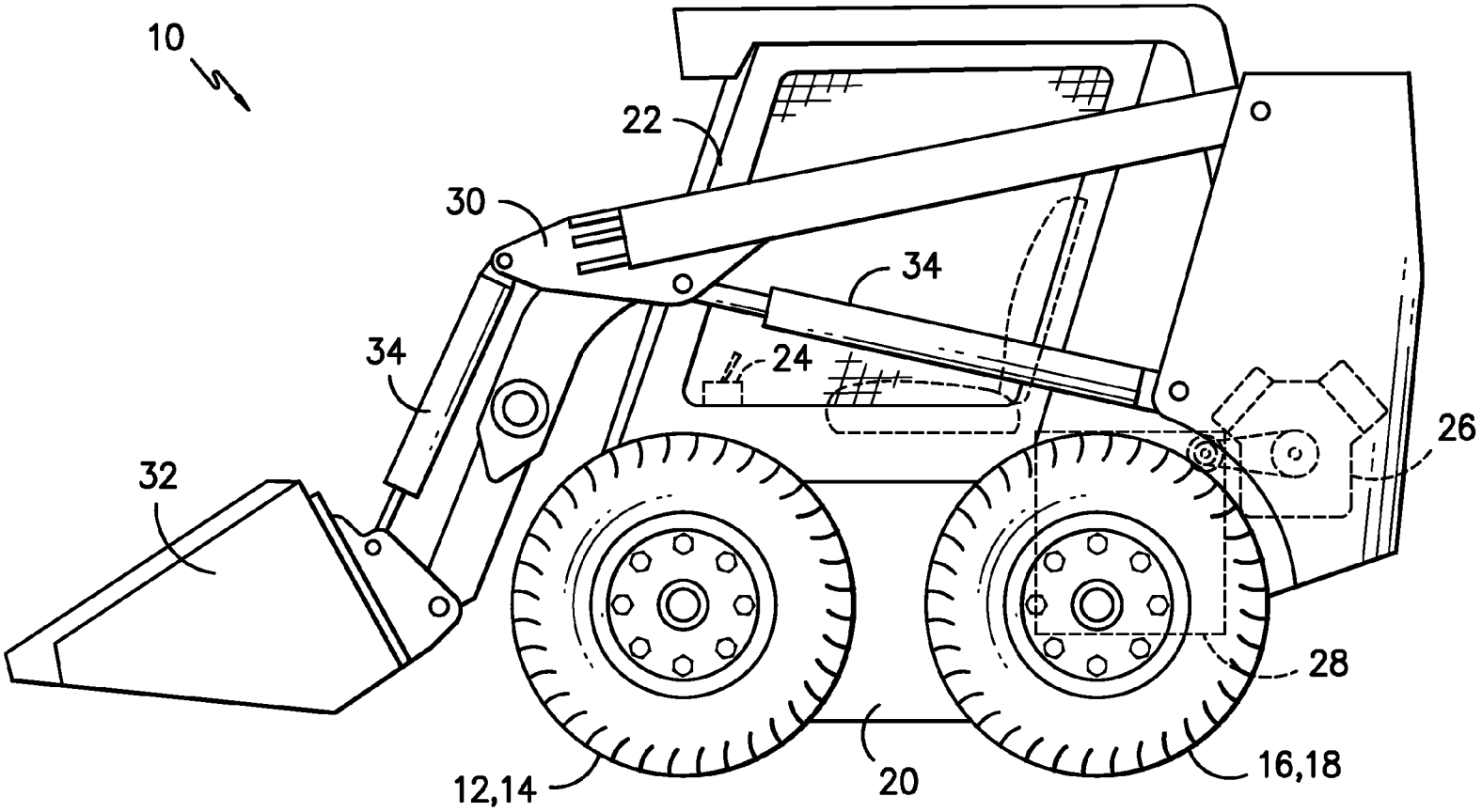
FIG. 3 illustrates a side view of one embodiment of a work vehicle.
Figure 4:
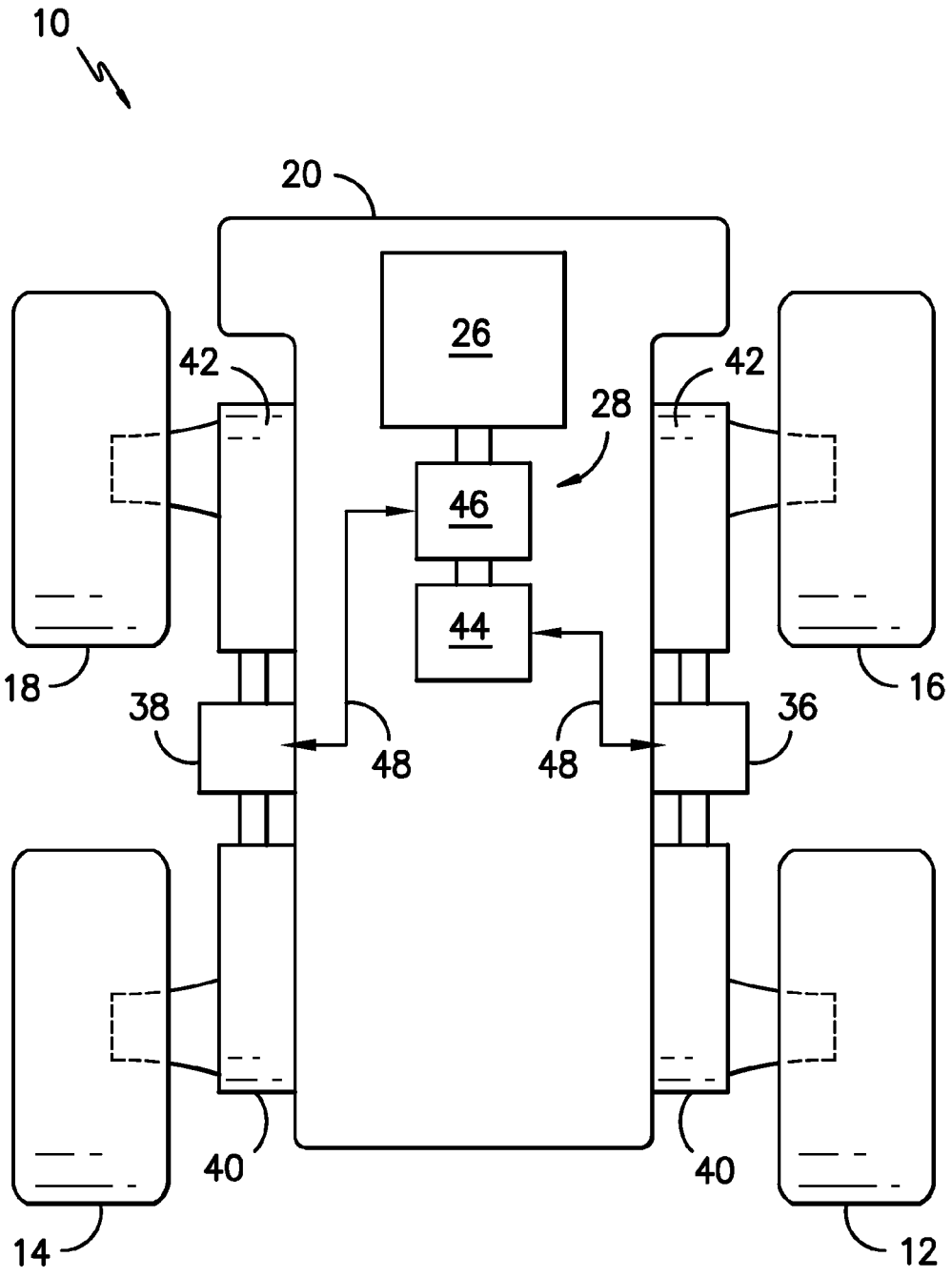
FIG. 4 illustrates a top, schematic view of various components of the work vehicle shown in FIG. 1, including a hydrostatic drive unit of the work vehicle.

Referring now to the drawings, FIGS. 3 and 4 illustrate different views of one embodiment of a work vehicle 10. Specifically, FIG. 3 illustrates a side view of the work vehicle 10 and FIG. 4 illustrates a top, schematic view of various components of the work vehicle 10 shown in FIG. 3. As shown, the work vehicle 10 is configured as a skid steer loader. However, in other embodiments, the work vehicle 10 may be configured as any other suitable work vehicle known in the art, such as various agricultural vehicles, earth-moving vehicles, road vehicles, all-terrain vehicles, off-road vehicles, other construction-related vehicles and/or the like.

As shown, the work vehicle 10 includes a pair of front wheels 12, 14, a pair of rear wheels 16, 18 and a chassis 20 coupled to and supported by the wheels 12, 14, 16, 18. An operator's cab 22 may be supported by a portion of the chassis 20 and may house various input devices, such as one or more electronic joysticks 24, for permitting an operator to control the operation of the work vehicle 10. In addition, the work vehicle 10 may include an engine 26 and a hydrostatic drive unit 28 coupled to or otherwise supported by the chassis 20. Moreover, as shown in FIG. 3, the work vehicle 10 may include a pair of loader arms 30 coupled between the chassis 20 and a bucket 32 or other suitable implement. Hydraulic cylinders 34 may also be coupled between the chassis 20 and the loader arms 30 and between the loader arms 30 and the bucket 32 to allow the bucket 30 to be raised/lowered and/or pivoted relative to the loader arms 30.

As particularly shown in FIG. 4, the hydrostatic drive unit 28 of the work vehicle 10 may include a pair of hydraulic motors (e.g., a first hydraulic motor 36 and a second hydraulic motor 38), with each hydraulic motor 36, 38 being configured to drive a pair of wheels 12, 14, 16, 18. For example, the first hydraulic motor 36 may be configured to drive the left-side wheels 12, 16 via front and rear axles 40, 42, respectively. Similarly, the second hydraulic motor 38 may be configured to drive the right-side wheels 14, 18 via front and rear axles 40, 42, respectively. Alternatively, the motors 36, 38 may be configured to drive the wheels 12, 14, 16, 18 using any other suitable means known in the art. For instance, in another embodiment, the motors 36, 38 may be coupled to the wheels via a suitable sprocket/chain arrangement (not shown) as opposed to the axles 40, 42 shown in FIG. 4.

Additionally, the hydrostatic drive unit 28 may include a pair of hydraulic pumps (e.g., a first hydraulic pump 44 and a second hydraulic pump 46) driven by the engine 26, which may, in turn, supply pressurized fluid to the motors. For example, as shown in FIG. 4, the first hydraulic pump 44 may be fluidly connected to the first motor 36 (e.g., via a suitable hydraulic hose or other fluid coupling 48) while the second hydraulic pump 46 may be fluidly connected to the second motor 38 (e.g., via a suitable hydraulic hose or other fluid coupling 48). As such, by individually controlling the operation of each pump 44, 46, the speed of the left-side wheels 12, 16 may be regulated independent of the right-side wheels 14, 18.

It should be appreciated that the configuration of the work vehicle 10 described above and shown in FIGS. 3 and 4 is provided only to place the present subject matter in an exemplary field of use. Thus, it should be appreciated that the disclosed joystick configuration may be readily adaptable to any manner of work vehicle configuration.

Figure 5:
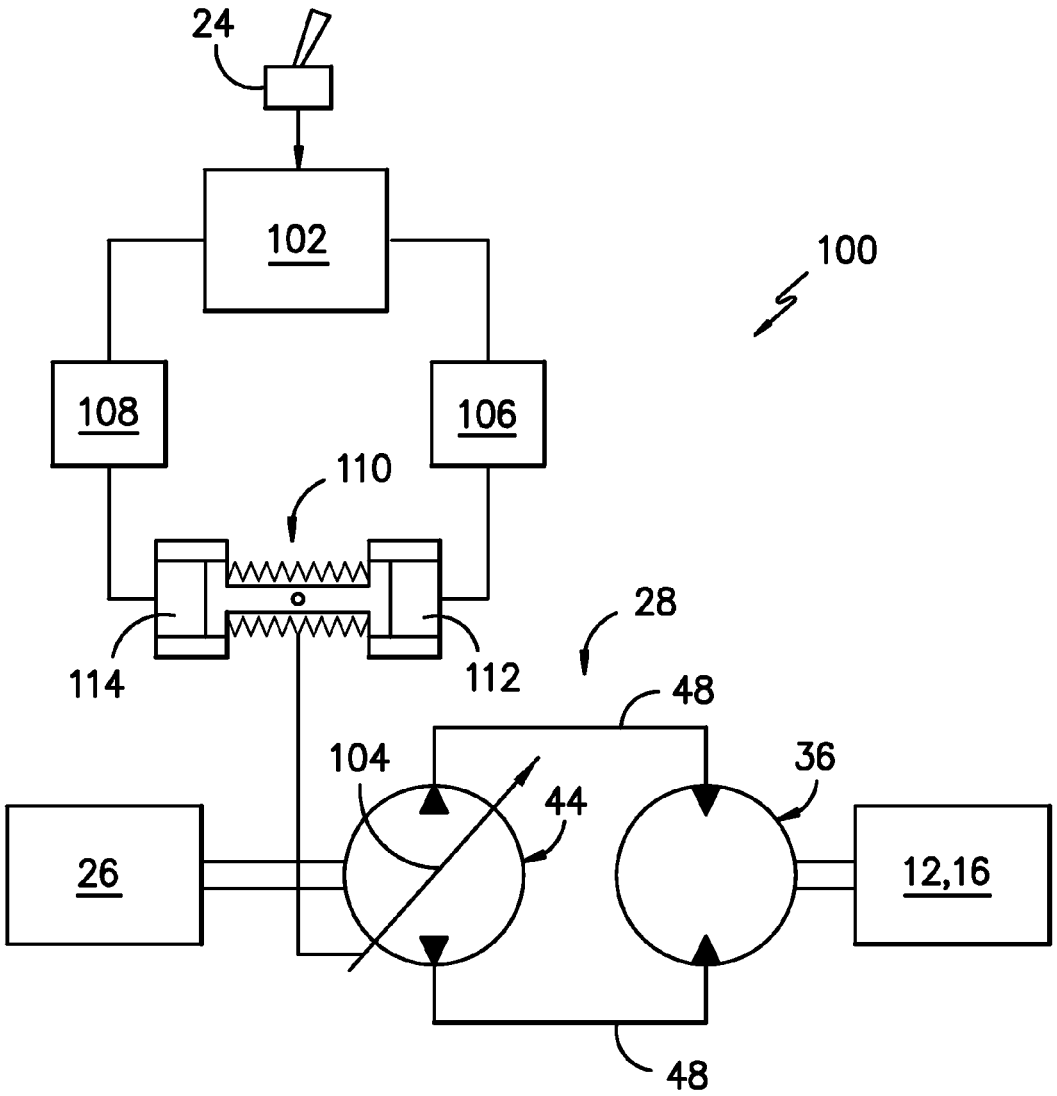
FIG. 5 illustrates a schematic view of one embodiment of a control system for controlling a hydrostatic drive unit of a work vehicle in accordance with aspects of the present subject matter.

Referring now to FIG. 5, one embodiment of a control system 100 for controlling various components of a hydrostatic drive unit 28 of a work vehicle 10 is illustrated in accordance with aspects of the present subject matter. As shown, the control system 100 includes a controller 102 configured to electronically control various aspects of the drive unit's operation. In general, the controller 102 may comprise any suitable processor-based device known in the art. For instance, the controller 102 may include one or more processor(s) and associated memory device(s) configured to perform a variety of computer-implemented functions.

The controller 102 may be communicatively coupled to various components for controlling the operation of the hydraulic pumps 44, 46 (and, thus, the hydraulic motors 36, 38). Specifically, the controller 102 is shown in the illustrated embodiment as being coupled to suitable components for controlling the operation of the first hydraulic pump 44 and the first hydraulic motor 36, thereby allowing the controller 102 to electronically control the speed of the left-side wheels 12, 16. However, it should be appreciated that the controller 102 may also be communicatively coupled to similar components for controlling the operation of the second hydraulic pump 46 and the second hydraulic motor 38, thereby allowing the controller 102 to electronically control the speed of the right-side wheels 14, 18.

As indicated above, the hydraulic pump 44 may be driven by the engine 26 and may be fluidly connected to the hydraulic motor 36 via suitable fluid couplings 48 (e.g., hydraulic hoses). The hydraulic motor 36 may, in turn, drive the left-side wheels 12, 16 of the vehicle. In several embodiments, the motor 36 may be configured as a fixed displacement motor while the hydraulic pump 44 may be configured as a variable displacement pump. Accordingly, to change the rotational speed of the motor 36 (and, thus, the rotational speed of the wheels 12, 16), the displacement of the hydraulic pump 44 may be varied by adjusting the position or angle of a swashplate (indicated by the arrow 104) of the pump 44, thereby adjusting the flow of hydraulic fluid to the motor 36.

To electronically control the displacement of the swashplate 104, the controller 102 may be commutatively coupled to suitable pressurize regulating valves 106, 108 (PRVs) (e.g., solenoid-activated valves) configured to regulate the pressure of hydraulic fluid supplied to a control piston 110 of the pump 44. Specifically, as shown schematically in FIG. 5, the controller 102 may be coupled to both a forward PRV 106 configured to regulate the pressure of the hydraulic fluid supplied to a forward chamber 112 of the control piston 110 and a reverse PRV 108 configured to regulate the pressure of the hydraulic fluid supplied to a reverse chamber 114 of the control position 110. By pressurizing the forward chamber 112, the swashplate 104 of the pump 44 may be displaced such that hydraulic fluid flows through the fluid loop defined by the hydrostatic drive unit 28 in a manner that causes the motor 36 to drive the wheels 12, 16 in the forward direction. Similarly, by pressurizing the reverse chamber 114, the swashplate 104 may be displaced such that hydraulic fluid flows through the fluid loop in a manner that causes the motor 36 to drive the wheels 12, 16 in the reverse direction.

As is generally understood, the current supplied to the PRV 106, 108 is directly proportional to the pressure supplied to the chamber 112, 114, the pressure difference of which is, in turn, directly proportional to the displacement of the swashplate 104. Thus, for example, by increasing the current command to the forward PRV 106 by a given amount, the pressure within the forward chamber 112 and, thus, the angle of the swashplate 104 may be increased by a proportional amount(s). As the angle of the swashplate 104 is increased, the flow of hydraulic fluid supplied to motor 36 is similarly increased, thereby resulting in an increase in the rotational speed of the wheels 12, 16 in the forward direction. A similar control strategy may be used to increase the rotational speed of the wheels 12, 16 in the reverse direction by increasing the current command supplied to the reverse PRV 108.

In addition, the current command provided by the controller 102 to the PRV (either PRV 106 or PRV 108 depending on the direction of travel) may be directly proportional to the operator input provided by the operator via a suitable input device. For example, as shown in FIG. 5, in one embodiment, the controller 102 may be communicatively coupled to one or more electronic joysticks 24 for providing operator inputs associated with the current command to be provided to the PRV 106, 108. In such an embodiment, the direction that the joystick 24 is moved by the operator (e.g., forward or back) may determine which PRV (e.g., the forward PRV 106 or the reverse PRV 108) is to receive a current command from the controller 102 while the magnitude of the movement of the joystick 24 (e.g., by moving the joystick to a 20%, 50% or 100% joystick position) may determine the magnitude of the current supplied to the PRV 106, 108. For example, as the joystick position is increased in the forward direction, the current supplied to the forward PRV 106 may be correspondingly increased, thereby increasing both the pressure within the forward chamber 112 and the swashplate angle (and, thus, the rotational speed of the motor 36). Accordingly, by providing operator inputs via the joystick 24, the operator may automatically control the rotational speed of the wheels 12, 16.

It should be appreciated that, although not shown, the work vehicle 10 may include two joysticks 24, with each joystick 24 controlling the operation of one of the pumps 44, 46. As a result, the speed and direction of the left-side wheels 12, 16 may be controlled independent of the right-side wheels 14, 18.

Figure 2:
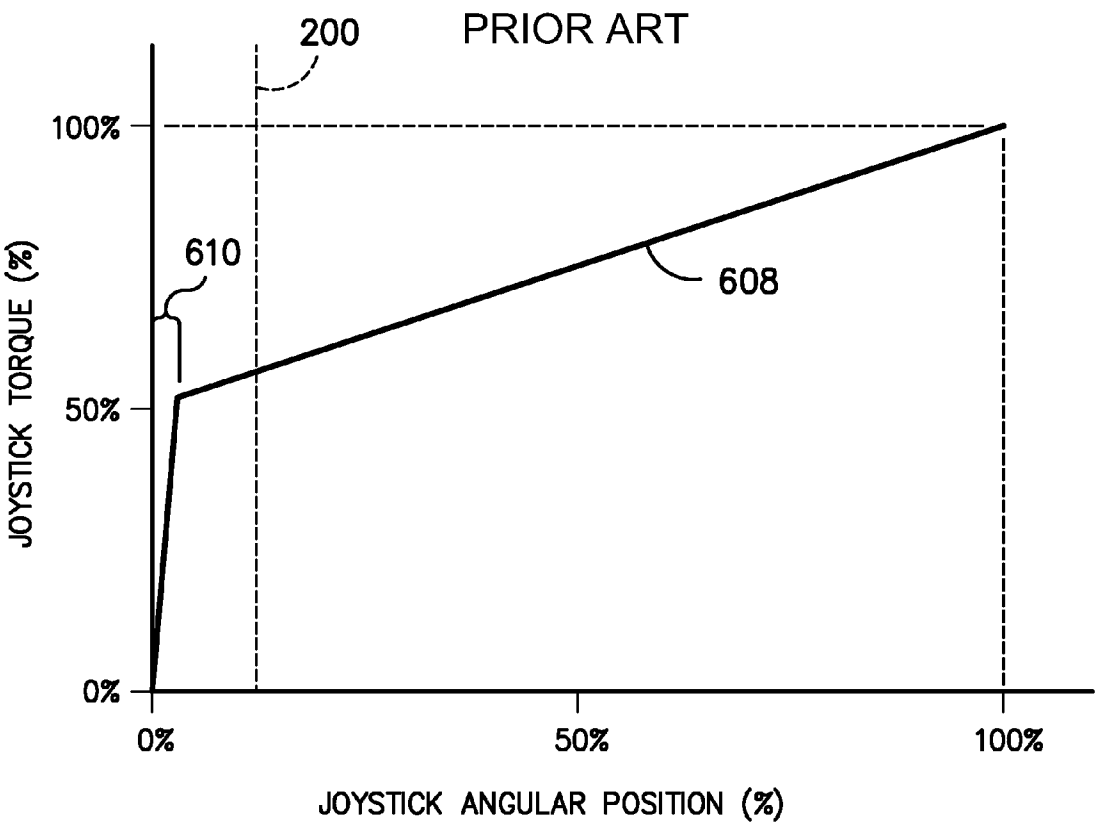
FIG. 2 illustrates a graph charting joystick torque (y-axis) versus joystick angular position (x-axis) for a conventional electronic joystick.
Figure 6:
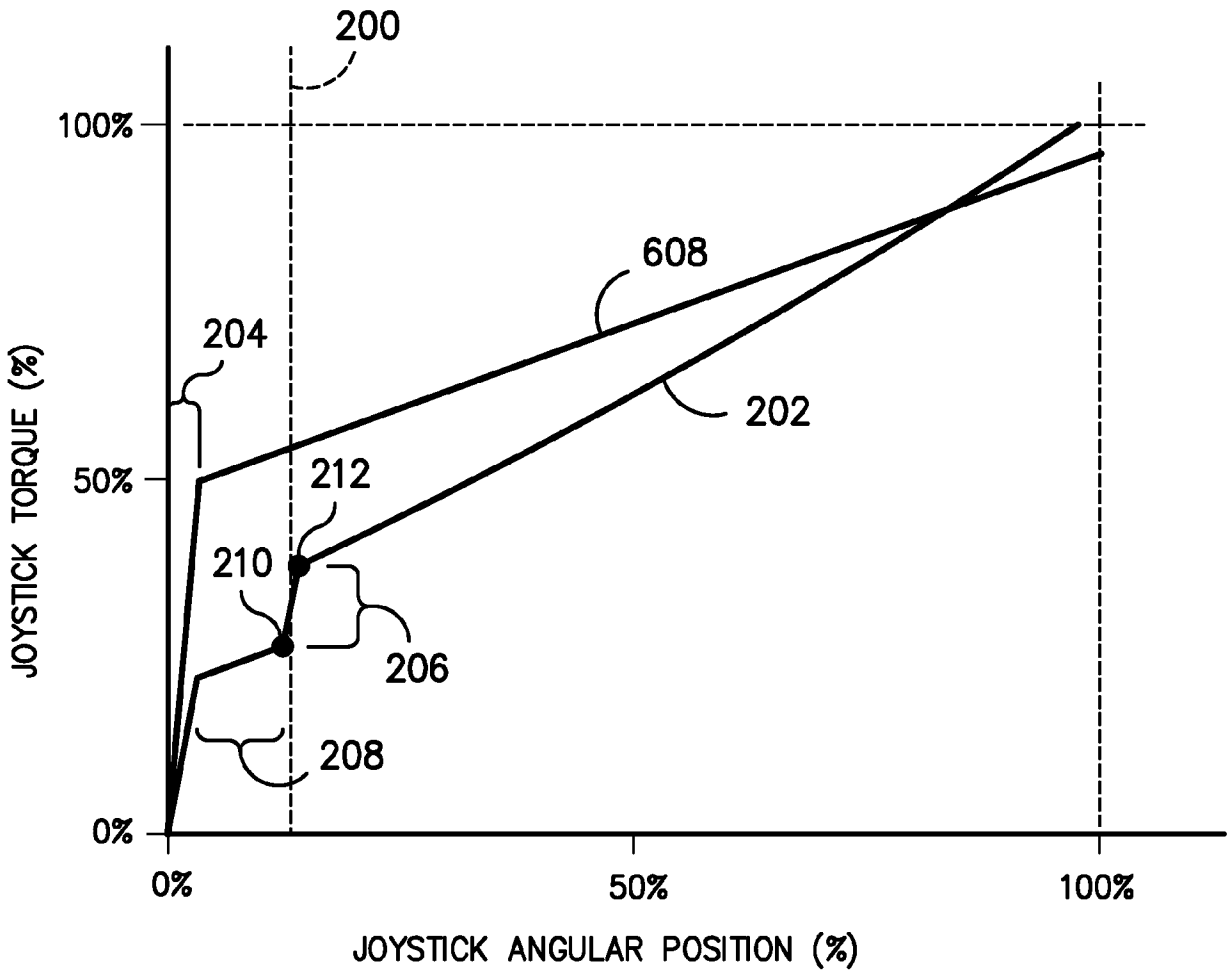
FIG. 6 illustrates a graph charting joystick torque (y-axis) versus joystick angular position (x-axis) for both a conventional electronic joystick and an electronic joystick configured in accordance with aspects of the present subject matter, particularly illustrating the change in force require to move the disclosed electronic joystick across the joystick position at which the work vehicle starts and stops motion.

Referring now to FIG. 6, a graph is illustrated that charts joystick torque (y-axis) versus joystick angular position (x-axis) for both a conventional electronic joystick (curve 608) and an electronic joystick (curve 202) configured in accordance with aspects of the present subject matter. As shown, each curve 202, 608 includes an initial region 204 at which the joystick force initially increases/decreases. Thereafter, as described above with reference to FIG. 2, the joystick force continues to increase/decrease linearly with joystick motion for the curve 608 associated with the conventional electronic joystick. However, the curve 202 associated with the disclosed joystick includes a substantial change in the joystick force (indicated by bracket 206) at the start/stop joystick position 200. Specifically, as shown in FIG. 6, the slope of the curve 202 changes significantly at the start/stop position 200 (e.g., between point 210 and 212). As a result, by using the disclosed electronic joystick, an operator may be provided with the desired feedback or "feel" at the start/stop point 200, thereby allowing for enhanced control of the work vehicle 10 (e.g., fine-tuned control at low speeds).

Figure 7:
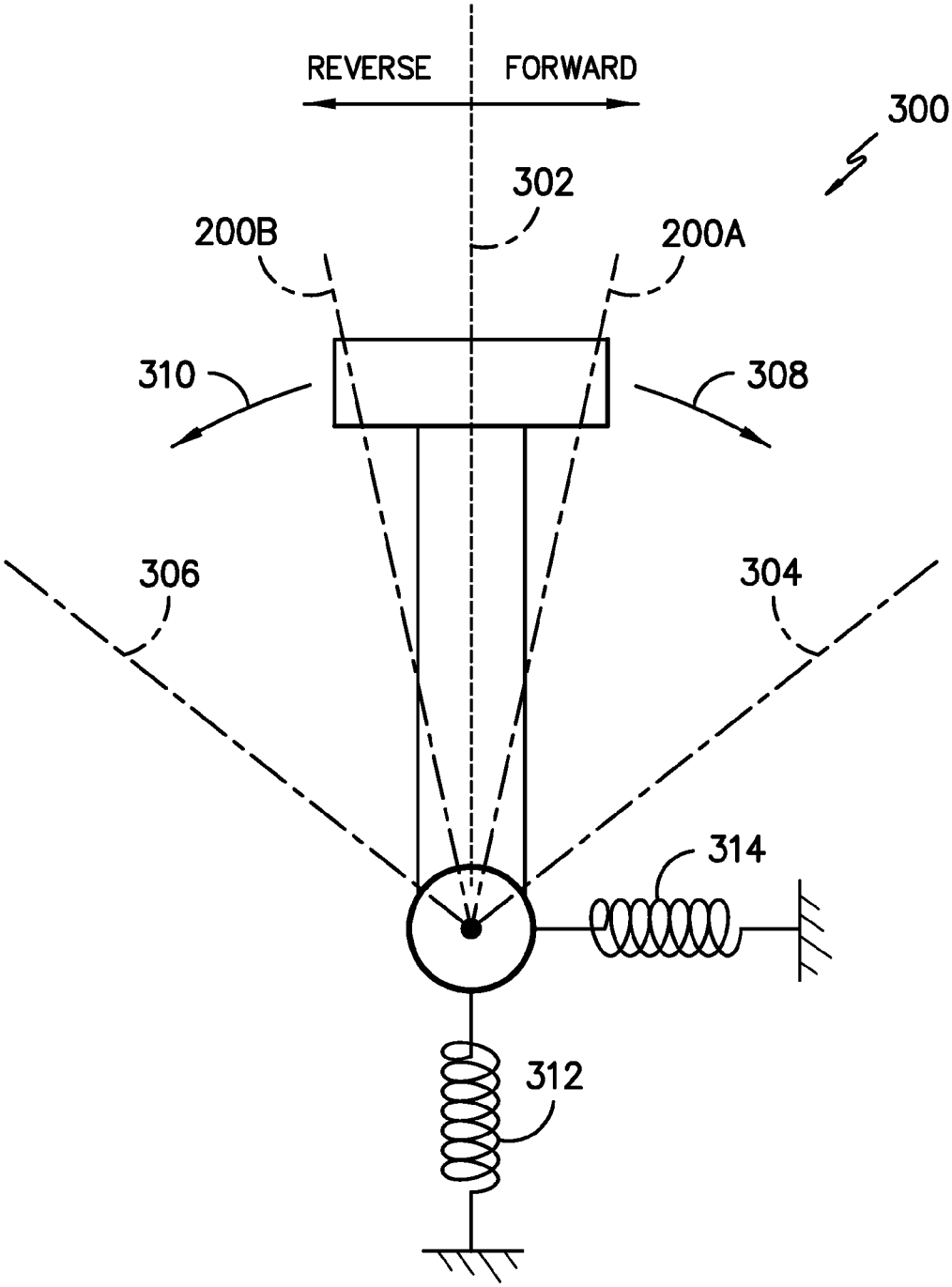
FIG. 7 illustrates a simplified, schematic view of one embodiment of an electronic joystick having a suitable mechanical configuration that may be utilized to achieve the change in force shown in FIG. 6.

In general, the change in force at the start/stop point 200 may be achieved using any suitable joystick arrangement/configuration. For example, FIG. 7 illustrates a simplified, schematic view of one embodiment of a joystick configuration that may be utilized to provide the desired feedback or "feel" with an electronic joystick 300. As shown, the joystick 300 includes a neutral position (indicated by line 302), a forward full stroke position (indicated by line 304) and a reverse full stroke position (indicated by line 306). In addition, the joystick 300 includes a forward start/stop position (indicated by line 200A) and a reverse start/stop position (indicated by line 200B). Thus, as the joystick 300 is moved in the forward direction (indicated by arrow 308), forward rotation of the corresponding wheels (e.g., the left-side wheels 12, 16) is initiated at the forward start/stop position 200A. Thereafter, the rotational speed of the wheels is increased as the joystick 300 is moved from the forward start/stop position 200A to the forward full stroke position 304. Similarly, as the joystick 300 is moved in the reverse direction (indicated by arrow 310), reverse rotation of the corresponding wheels (e.g., the left-side wheels 12,16) is initiated at the reverse start/stop position 200B. Thereafter, the rotational speed of the wheels is increased as the joystick 300 is moved from the reverse start/stop position 200B to the reverse full stroke position 206.

In the illustrated embodiment, the joystick 300 includes a dual-spring configuration to provide for the desired change in force (bracket 206 in FIG. 6) at the start/stop positions 200A, 200B. Specifically, as shown in FIG. 7, a first spring 312 and a second spring 314 may be coupled to the joystick 300. In such an embodiment, the first spring 312 may be configured to apply an initial spring force against the joystick 300 as it is moved towards the start/stop position 200A, 200B, thereby providing for the linear force change region 208 shown in FIG. 6. However, as the joystick 300 is moved to the start/stop position 200A, 200B, the second spring 314 is engaged and begins to apply an additional force against the joystick 300, thereby providing for a substantial change in the force required to move the joystick 300 across the start/stop position 200A, 200B (bracket 206 in FIG. 6). Thereafter, the joystick force (as applied by both springs) may increase linearly as the joystick 300 is moved away from the start/stop position 200A, 200B towards the corresponding full stroke position 304, 306.

It should be appreciated that, although the illustrated embodiment uses a dual-spring configuration, any other suitable configuration/arrangement may be utilized to provide for the desired change in joystick force at the start/stop position(s). For instance, in another embodiment, a single spring or three or more springs may be coupled to the joystick 300. Similarly, in other embodiments, the change in joystick force may be provided using any other suitable mechanical arrangement, such as by using a compressible and/or expandable material that engages the joystick 300 at the start/stop position(s) and expands/contracts with further movement of the joystick or by using any other suitable force application means.

Figure 9:
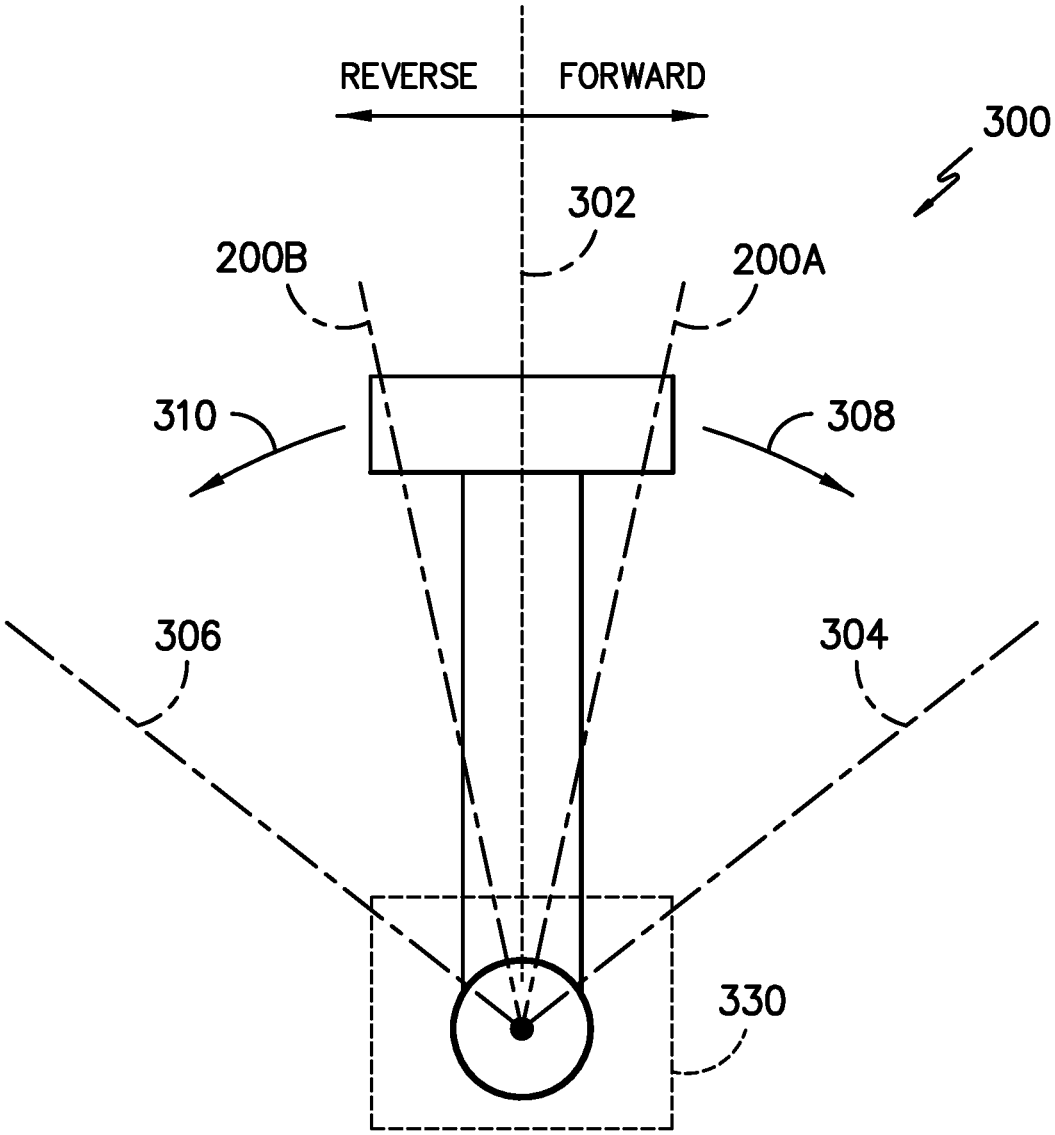
FIG. 9 illustrates a simplified, schematic view of one embodiment of an electronic joystick having a suitable electrical configuration that may be utilized to achieve the change in force shown in FIG. 6.

Additionally, in further embodiments, as opposed to a mechanical arrangement, an electrical arrangement may be utilized to provide for the change in joystick force at the start/stop position(s). For example, FIG. 9 illustrates a simplified, schematic view of the joystick 300 shown in FIG. 7 having an electrical arrangement that may be utilized to provide the desired feedback or "feel" to the operator. As shown, the joystick 300 may be coupled to a force application device 330 configured to apply an additional force to the joystick 300 in response to an electrical stimulus. For instance, in several embodiments the force application device 330 may correspond to an electric solenoid configured to be switched on/off at the start/stop positions, thereby providing for the change in force. In such an embodiment, the solenoid may be controlled using the vehicle controller 102 or using any other suitable control means, such as an analog circuit.

Figure 8:
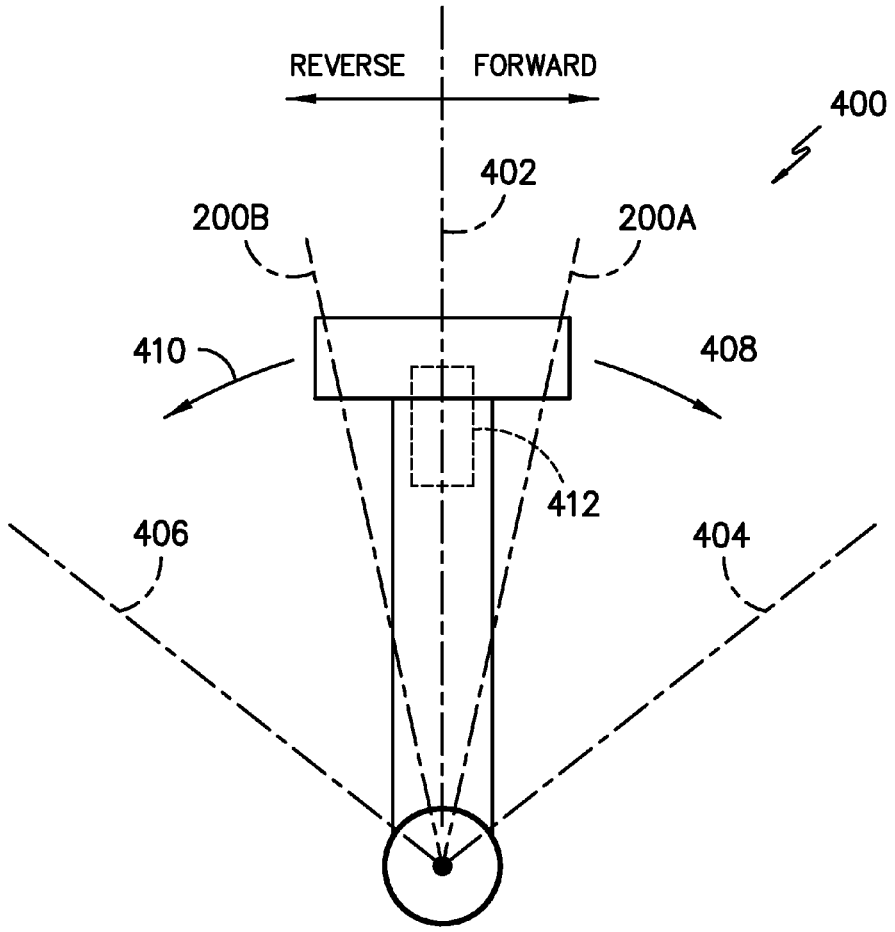
FIG. 8 illustrates a simplified, schematic view of one embodiment of an electronic joystick configured to provide a vibratory response when the joystick is moved across the joystick position at which the work vehicle starts and stops motion.

It should also be appreciated that, in addition to force-related feedback or as an alternative thereto, the disclosed joystick may also be configured to provide any other suitable feedback that provides an indication that the vehicle is about to start/stop movement. For example, FIG. 8 illustrates a simplified, schematic view of one embodiment of a joystick configuration 400 that provides the operator a vibratory response when a joystick 400 is moved to the start/stop position. As shown, similar to the joystick 300 described above, the joystick 400 includes a neutral position (indicated by line 402), a forward full stroke position (indicated by line 404) and a reverse full stroke position (indicated by line 406). In addition, the joystick includes a forward start/stop position (indicated by line 200A) and a reverse start/stop position (indicated by line 200B). Thus, as the joystick 400 is moved in the forward direction (indicated by arrow 408) from the forward start/stop position 200A towards the forward full stroke position 404, the forward rotational speed of the corresponding wheels (e.g., the left-side wheels 12, 16) may be increased. Similarly, as the joystick 400 is moved in the reverse direction (indicated by arrow 410) from the reverse start/stop position 200B towards the reverse full stroke position 406, the reverse rotational speed of the wheels may be increased.

Moreover, as shown in FIG. 8, the joystick 400 includes a vibration source 410 coupled thereto and/or integrated therein that is configured to provide a vibratory response or other suitable haptics-related feedback to the operator. Specifically, in several embodiments, the vibration source 410 may be one or more actuators, motors and/or other suitable devices configured to provide mechanical motion in response to an electrical stimulus. For example, one or more vibratory motors may be installed within the joystick 400 and communicatively coupled to the vehicle's controller 102. Thus, when the joystick 400 is moved adjacent to and/or across one of the start/stop positions 200A, 200B, the controller 102 may transmit a suitable control signal to the motor(s) in order to generate a vibratory response. Alternatively, the motor(s) may be coupled to any other suitable electrical stimuli, such as an electrical switch that is closed/opened when the joystick 400 is moved across the start/stop position 200A, 200B.

Figure 10:
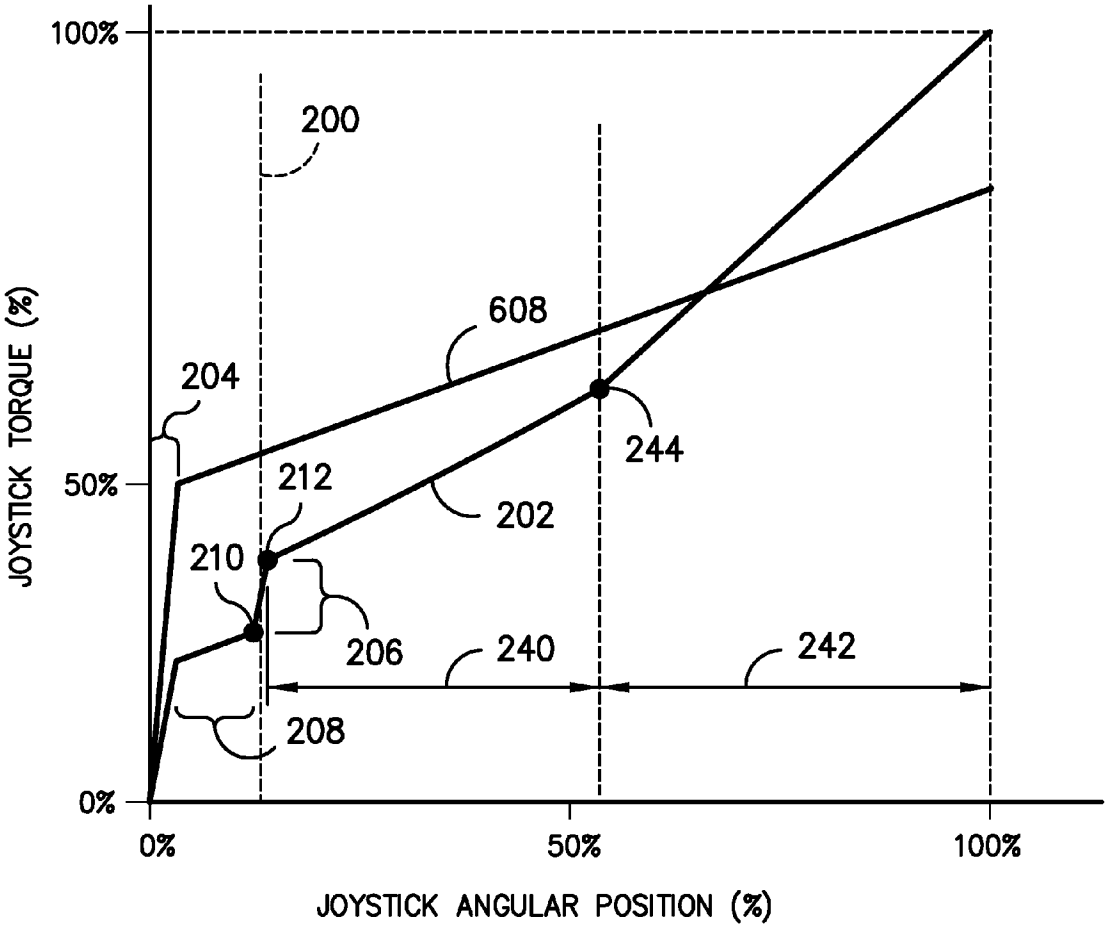
FIG. 10 illustrates another graph charting joystick torque (y-axis) versus joystick angular position (x-axis) for both a conventional electronic joystick and an electronic joystick configured in accordance with aspects of the present subject matter, particularly illustrating an example in which the rate of change in the amount of torque required to move the disclosed electronic joystick is varied during stroking and/or de-stroking of such joystick.

It should be appreciated that, although FIG. 6 illustrates an example in which the required joystick torque increases at a constant rate beyond the change in torque provided at the start/stop joystick position (e.g., beyond point 212), the rate of change may also be varied at one or more other joystick positions. For example, FIG. 10 illustrates a similar graph to that shown in FIG. 6 that charts joystick torque (y-axis) versus joystick angular position (x-axis) for both a conventional electronic joystick (curve 608) and an electronic joystick (curve 202) configured in accordance with aspects of the present subject matter. However, as shown in FIG. 10, unlike the constant rate of change provided in the example of FIG. 6, the rate at which the required joystick torque is increased changes at a given joystick position beyond the start/stop position (e.g., at point 244). As such, a first range 240 of joystick positions is defined across which the joystick torque is increased at a first rate of change (e.g., between points 212 and 244) and a second range 242 of joystick positions is defined across which the joystick torque is increased at a different, second rate of change (e.g., at joystick positions beyond point 244). Such a configuration may allow for the sensitivity of the joystick to be specifically tailored, such as by providing for a smooth change in velocity along range 240 and then providing for a coarse change in velocity along range 242.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for controlling a work vehicle, the system comprising:

a controller configured to control motion of the work vehicle;

an electronic joystick communicatively coupled to the controller, the electronic joystick configured to transmit signals to the controller as the electronic joystick is moved between a neutral position and a full stroke position, the electronic joystick being configured such that a varying joystick force is required to move the electronic joystick between the neutral and full stroke positions, wherein a rate of change of the joystick force is varied as the electronic joystick is moved across a start/stop position defined between the neutral and full stroke positions, and wherein the variation in the rate of change of the joystick force at the start/stop position is provided by first and second springs operably coupled to the electronic joystick.

2. The system of claim 1, wherein the first spring is configured to apply a first force against the electronic joystick as the electronic joystick is moved from the neutral position and the second spring is configured to apply a second force against the electronic joystick as the electronic joystick is moved across the start/stop position such that the rate of change in the joystick force is increased across the start/stop position.

3. The system of claim 1, wherein the joystick force is defined by a torque curve, wherein a slope of the torque curve increases at or adjacent to the start/stop position.

4. The system of claim 3, wherein the slope of the torque curve at a joystick position defined between the neutral position and the start/stop position is less than the slope of the torque curve at the start/stop position.

5. The system of claim 3, wherein the slope of the torque curve at a joystick position defined between the start/stop position and the full-stroke position is less than the slope of the force curve at the start/stop position.

6. The system of claim 1, further comprising a force application device configured to apply a force against the electronic joystick at the start/stop position in response to an electric stimulus.

7. The system of claim 6, wherein the force application device comprises an electric solenoid coupled to the electronic joystick.

8. The system of claim 1, wherein the rate of change in the joystick force is constant as the electronic joystick is moved between the start/stop position and the full stroke position.

9. The system of claim 1, further comprising a vibration source associated with the electronic joystick, wherein the vibration source is configured to generate a vibratory response when the electronic joystick is moved across the start/stop position.

10. A system for controlling a work vehicle, the system comprising:

a controller configured to control motion of the work vehicle;

an electronic joystick communicatively coupled to the controller, the electronic joystick configured to transmit signals to the controller as the electronic joystick is moved between a neutral position and a full stroke position, the electronic joystick being configured such that a varying joystick force is required to move the electronic joystick between the neutral and full stroke positions, wherein a rate of change of the joystick force is varied as the electronic joystick is moved across a start/stop position defined between the neutral and full stroke positions, and wherein the rate of change in the joystick force is varied at least once as the electronic joystick is moved between the start/stop position and the full stroke position.

11. The system of claim 10, wherein the rate of change in the joystick force is varied as the electronic joystick is moved between the start/stop position and the full stroke position such that a first range of joystick positions is defined across which the joystick force increases at a first rate of change and a second range of joystick positions is defined across which the joystick force increases at a second rate of change.

12. The system of claim 10, further comprising a vibration source associated with the electronic joystick, wherein the vibration source is configured to generate a vibratory response when the electronic joystick is moved across the start/stop position.

13. A work vehicle, comprising:

an engine;

a hydrostatic drive unit coupled to the engine, the hydrostatic drive unit being configured to adjust a travel speed of the work vehicle;

a controller communicatively coupled to the hydrostatic drive unit; and an electronic joystick communicatively coupled to the controller, the electronic joystick configured to transmit signals to the controller for controlling the hydrostatic drive unit as the electronic joystick is moved between a neutral position and a full stroke position, the electronic joystick being configured such that a varying joystick force is required to move the electronic joystick between the neutral and full stroke positions, wherein a rate of change of the joystick force is varied as the electronic joystick is moved across a start/stop position defined between the neutral and full stroke positions; and a first spring and a second spring associated with the electronic joystick, the first spring being configured to apply a first force against the electronic joystick as the electronic joystick is moved from the neutral position, the second spring being configured to apply a second force against the electronic joystick as the electronic joystick is moved across the start/stop position such that the rate of change in the joystick force is increased across the start/stop.

14. The work vehicle of claim 13, further comprising a vibration source associated with the electronic joystick, the vibration source being configured to generate a vibratory response when the electronic joystick is moved across the start/stop position.

15. The work vehicle of claim 13, wherein the joystick force is defined by a torque curve, wherein a slope of the torque curve increases at or adjacent to the start/stop position.

16. The work vehicle of claim 13, wherein the rate of change in the joystick force is constant as the electronic joystick is moved between the start/stop position and the full stroke position.

17. A work vehicle, comprising:

an engine;

a hydrostatic drive unit coupled to the engine, the hydrostatic drive unit being configured to adjust a travel speed of the work vehicle;

a controller communicatively coupled to the hydrostatic drive unit; and an electronic joystick communicatively coupled to the controller, the electronic joystick configured to transmit signals to the controller for controlling the hydrostatic drive unit as the electronic joystick is moved between a neutral position and a full stroke position, the electronic joystick being configured such that a varying joystick force is required to move the electronic joystick between the neutral and full stroke positions, wherein a rate of change of the joystick force is varied as the electronic joystick is moved across a start/stop position defined between the neutral and full stroke positions, and wherein the rate of change in the joystick force is varied at least once as the electronic joystick is moved between the start/stop position and the full stroke position.

18. The work vehicle of claim 17, further comprising a vibration source associated with the electronic joystick, the vibration source being configured to generate a vibratory response when the electronic joystick is moved across the start/stop position.

19. The work vehicle of claim 17, wherein the joystick force is defined by a torque curve, wherein a slope of the torque curve increases at or adjacent to the start/stop position.

20. The work vehicle of claim 17, wherein the rate of change in the joystick force is constant as the electronic joystick is moved between the start/stop position and the full stroke position.

* * * * *